United States Patent [19]

Becker et al.

[11] Patent Number: 4,810,252

[45] Date of Patent: Mar. 7, 1989

[54] PROCESS FOR TANNING LEATHER

[75] Inventors: Hermann Becker, Rodgau; Werner Lotz, Niedernhausen; Karlfried Keller, Frankfurt am Main, all of Fed. Rep. of Germany

[73] Assignee: Hoechst Aktiengesellschaft, Frankfurt, Fed. Rep. of Germany

[21] Appl. No.: 104,252

[22] Filed: Oct. 5, 1987

[30] Foreign Application Priority Data

Sep. 25, 1986 [DE] Fed. Rep. of Germany ..... 3632638
Apr. 4, 1987 [DE] Fed. Rep. of Germany ..... 3711458

[51] Int. Cl.[4] ..... C14C 3/18
[52] U.S. Cl. ..... 8/94.24; 8/94.19 R
[58] Field of Search ..... 8/94.24, 94.19 R; 525/509

[56] References Cited

U.S. PATENT DOCUMENTS 2,303,209 11/1942 Grim ..... 8/94.94

*Primary Examiner*—Paul Lieberman
*Assistant Examiner*—John F. McNally
*Attorney, Agent, or Firm*—Connolly & Hutz

[57] ABSTRACT

Use of a resin mixture of, or of a mixed resin from, a melamine-formaldehyde resin and an anionically modified melamine-formaldehyde resin for tanning leather. The anionic modification of the melamine-formaldehyde resin is obtained by preparing the resin in the presence of alkali metal sulfite, alkali metal hydrogensulfite or alkali metal sulfamate. By partial modification it is possible to obtain a mixed resin, while mixing a modified with an unmodified resin gives a resin mixture.

5 Claims, No Drawings

PROCESS FOR TANNING LEATHER

DESCRIPTION

Chrome tanning, which in the course of the past 60 to 80 years has come to occupy a dominating place in leathermaking, has come under increasing ecological pressure in the last decade because of the high water pollution with chromium(III) salts.

Since a return to the tanning methods involving vegetable or animal tannins which were employed for thousands of years before the advent of chrome tanning would have to be paid for with drastically reduced performance levels of the leather, for example in the light fastness or heat resistance, there has been no shortage of attempts to replace the chromium(III) salts used in tanning with other purely mineral tannins, such as titanium, zirconium or aluminum salts, or with combinations thereof with vegetable tannins.

Yet all these processes have in common that they merely replace the chromium salt by another mineral salt in the effluent and additionally, in some cases, lead to an increased pollution of the effluent with alkali metal salts.

Nor has there been any shortage of attempts in the past to replace mineral tannages with melamine-formaldehyde resin tannages. This involved drumming the methylol group-containing resins, dissolved in water, in a very short liquor into the bated or, alternatively, lightly pickled pelt and subsequently initiating the condensation of the resins by adding acids, preferably formic acid.

It is known from the literature (Miekeley "Das Leder" 4 (1953), page 298 et seq.; Kutsidi, Strakhov, Kozh, Obuvn. Prom. 5, 16 (1963); CA 60, 10940f (1964)) that, although unetherified melamine-formaldehyde resins can produce adequate tanning effects on pickled skins without added chromium, the leathers thus tanned are highly water-adsorbent and tend to become very brittle, in particular in the course of storage.

Methyl- or butyl-etherified melamine-formaldehyde resins have also been proposed as tannins (Miekeley (loc. cit.); Hachihama, Kyogoku, Technol.-Repts. Osaka Univ. 6, 397 (1956); CA 52, 10622a (1958)). However, leathers tanned with butyl-etherified melamine-formaldehyde resins were too thin, while leathers tanned with methyl-etherified melamine-formaldehyde resins were pure white, had an excellent light fastness and bulkiness and a high alkali resistance and, owing to their cationic character, exhibited a high recipiency for acid and substantive dyestuffs. However, in addition to these favorable properties these leathers also had a very serious defect in respect of their tensile strength behavior as a function of time. Immediately after tanning, these leathers tanned with melamine-formaldehyde resins had a very high tensile strength. Even after a brief period of storage, however, the tensile strength decreased markedly and fell to 50% or less of the original value within a period of about four weeks.

Tanning the skin with melamine-formaldehyde resins alone was therefore not possible despite the other excellent leather properties obtained, and the usefulness of this class of resins was restricted to the retanning of chrome leather.

It has now been found, surprisingly, that high-quality leathers can be produced without the time dependent deterioration in the tensile strength if the tanning agent used comprises resin mixtures of, or mixed resins from, a customary melamine-formaldehyde resin and an anionically modified melamine-formaldehyde resin.

Preference, however, is given to the use of a resin mixture which is 20 to 80% a melamine-formaldehyde resin and 80 to 20% by weight an anionically modified melamine-formaldehyde resin.

The melamine resins which are free of anionic groups are prepared in a conventional manner by alkaline condensation of melamine with 1.5–6 moles of formaldehyde. The condensation can also be carried out in the presence of plasticizers known for the melamine resin condensation, such as monohydric and polyhydric alcohols, and non-reducing sugars with partial etherification. Examples of suitable additional alcohols of this type are: methanol, ethanol, glycol, glycerol, sorbitol, other monohydric or polyhydric alcohols individually or mixtures with one another. The non-reducing sugar used is normally sucrose (=beet sugar, cane sugar). It is also possible to use a mixture of several non-reducing sugars. The amount of these alcohols or sugars is about 0 to 20% by weight of the total solid resin. The melamine resins described here, however, should not contain any anionic groups. Up to 50% by weight of this melamine resin can also be replaced by other amino resin formers, for example guanamines, dicyandiamide or urea.

The anionically modified melamine resin used as the second component is prepared in the same way as the non-modified resin described. In the preparation of this resin, however, at least 0.3 mole, preferably up to 1.5 moles, of an alkali metal sulfite, alkali metal hydrogensulfite or alkali metal sulfamate are added per mole of melamine, so that the resulting resin has the appropriate number of sulfo groups and thus anionic properties. The alkali metal sulfites or alkali metal sulfamates used are for example potassium sulfite, potassium sulfamate, sodium sulfite or sodium sulfamate in the form of individual compounds or in the form of mixtures of several alkali metal sulfites and/or alkali metal sulfamates. In the same way it is also possible to employ the hydrogensulfites.

The two types of resin can be prepared separately and then be mixed in powder form or as liquid solutions. It is a second aspect of the present invention to prepare a mixed resin and use it in tne process according to the invention. Herein a customary melamine-formaldehyde resin is prepared in one batch in the presence of an appropriately reduced amount of sulfite or sulfamate.

For such mixed resins, the same melamine resins come into consideration as described above.

To obtain the partial anionic modification of these resins, 0.15 to 0.8 mole of an alkali metal sulfite, alkali metal hydrogensulfite or alkali metal sulfamate are added per mole of melamine in the course of the preparation, so that the resulting resin carries the appropriate number of sulfo groups and thus has anionic properties. The alkali metal sulfites or alkali metal sulfamates used are for example potassium sulfite, sodium sulfite, potassium hydrogensulfite, sodium hydrogensulfite, potassium sulfamate or sodium sulfamate in the form of individual compounds or in the form of mixtures of several alkali metal sulfites and/or alkali metal sulfamates.

This partially anionically modified resin is obtained in the form of a liquid solution and can directly be used in this form for tanning. This liquid formulation is distinguished by improved stability over a similar resin which is obtained by mixing an unmodified melamine resin with an anionically modified melamine resin.

In the separate use of the resin components described above, it has now been found that the unmodified resin does not tend to precipitate in acidic tan liquor, while the same is true of the anionically modified resin in alkaline tan liquor.

The resin mixtures or mixed resins thus prepared are used in the tanning process in a conventional manner. For example, skins of whatever animal species which have been soaked, limed and bated in a conventional manner are treated in a conventional manner in an aqueous liquor at a pH of 7 to 8.5 and at temperatures of 30° to 45° C. with 4 to 20%, based on pelt weight, of the resin solutions used according to the invention in the tanning vessel customary in tanneries for about 6 to 8 hours. The temperature of the liquor is then raised as high as 50° C., and after a further period of agitation of 1 hour, 0.5 to 3%, based on pelt weight, of an acid catalyst is added to the bath. The acid catalysts used can be acids, in particular organic acids which do not damage the skin, such as, for example, formic acid, or acidic salts, such as, for example, ammonium chloride, alone or mixed with each other. Thereafter the leathers are aged and further processed like any other tanned skin material.

The process can be successfully used on any type of leather, fur or fur skin.

The leathers obtained in the process according to the invention have, depending on the way the process is carried out, shrinkage temperatures of 70° to 90° C., have a high bulkiness, are soft to firm, have, owing to their predominantly cationic character, very good dyeing properties for the dyeing with commercially available anionic dyestuffs and, owing to their white color, even in cross-section, represent an excellent basis for the production of pure white leathers. They are tight-grained, have a very good light fastness and similar abrasion properties, tensile strength and tear propagation behavior as chrome-tanned leather, and also good self-extinguishing properties after contact with an igniting flame, and make it possible to use any kind of after-treatment customary in leather making, such as retanning, fatliquoring or finishing.

The particular advantages of the process according to the invention, in addition to their very good leather properties and the possibility of producing chrome- or mineral-free leather, are the environmental acceptability and simplicity of the process. The process dispenses not only with the effluent-polluting pickling before tanning but also with the neutralization step required in the mineral tanning process. The tannery effluents are not polluted by any ecologically unsafe mineral salts whatsoever. The essential advantage of the process according to the invention is that no significant tensile strength loss occurs in the course of ageing the leather.

Examples relating to the synthesis of the resins

EXAMPLE 1

Resin A

A glass flask equipped with a stirrer is charged with 342 g of 39% formaldehyde, followed by 2.5 ml of 2N NaOH, 8 g of 70% sorbitol, 35 g of sugar 240 ml of deionized water and 340 g of melamine, and the mixture is heated to 85° C. and is condensed at that temperature to a water dilutability of 1:1.4, measured at 20° C. The resin solution is cooled to room temperature and spray-dried. This gives about 520 g of pulverulent resin.

EXAMPLE 2

Resin B

A glass flask is charged in succession with 923 g of 39% formaldehyde, 2 g of calcium carbonate, 165 g of sugar, 170 ml of deionized water, 297 g of 40% sodium sulfamate solution, 252 g of melamine and 87 g of urea in the stated order, and the mixture is heated to 85° C. and is condensed at that temperature until the dilutability with saturated NaCl solution, measured at 20° C., is 1:2.5. The mixture is then cooled down to room temperature and spray-dried to give about 950 g of pulverulent resin.

EXAMPLE 3

Cocondensate

A glass flask is charged in succession with 804 g of 39% formaldehyde, 5 ml of 2N NaOH, 8 g of 70% sorbitol, 118 g of sugar, 325 ml of deionized water, 149 g of 40% sodium sulfamate, 466 g of melamine and 44 g of urea in the stated order, and the mixture is raised to 85° C. and condensed at that temperature until the dilutability with saturated NaCl solution, measured at 20° C., is 1:2.5. The solution is then cooled down to room temperature. The resin can be used in this form or after spray-drying in the form of a powder.

EXAMPLE 4

Cocondensate

A glass flask is charged with
804 g of 39% strength formaldehyde
76 g of methanol
6 ml of 10N NaOH
8 g of 70% strength sorbitol
118 g of sugar
325 ml of distilled $H_2O$
298 g of 40% strength Na-sulfamate and
466 g (3.7 mol) of melamine. The pH is 10.6–11. The mixture is heated to 85° in about 40 min. and is condensed at that temperature for about 2 h to a dilutability with saturated sodium chloride solution of 1:4 (measured after cooling down to 23° C.). Cooling down to room temperature gives
2100 g of a clear, highly fluid resin; solids content (2 g, 1 h, 120° C.): 47%, viscosity: 14 DIN sec., pH: 9.6–9.8, density: 1.215, turbidity time: 110 min.; curing time: 140 min., shelf life of so far 6 months, no flash point up to the boil.

A leather tanned with this resin exhibited no loss in tensile strength unlike the abovementioned prior art.

EXAMPLE 5

Cocondensate

A glass flask is charged with
627 g (2.2×3.7 mol) of 39% formaldehyde,
6 ml of 10N NaOH,
177 g of sugar,
550 ml of distilled $H_2O$,
288 g (0.3×3.7 mol) of 40% strength sodium hydrogen-sulfite dissolved in $H_2O$ and
466 g (3.7 mol) of melamine. The pH is 10.3–10.6. 1 hour of stirring at RT is followed by heating to 85° C. in about 10 min. and condensing at that temperature for about 3 hours to a dilutability with saturated NaCl solution of 1:4, measured at room temperature. Cooling down to room temperature gives:

2100 g of clear, highly fluid resin.
Solids content (2 g, 1 h, 120° C.) 47%
Viscosity: 14 DIN sec., pH: 9.2
Density: 1.231, curing time at 100°: 85–90 min.
no flash point up to the boil.

A leather tanned with this resin exhibited no loss in tensile strength unlike the abovementioned prior art.

Application examples

EXAMPLE 6

Cattle hide is soaked, limed, fleshed, delimed and bated, all the steps being carried out as customary in the practice of leathermaking. The pH of the pelt after bating is 7.8.

The percentages of the further process steps relate to the fleshed weight of the cattle hide. The pelt is introduced into a customary tanning vessel in 50% water at 38° C., 6% of a 1:1 mixture of the resins A and B, prepared in accordance with Examples 1 and 2, is added, and agitation continues for 6 hours. A further 50% water at 55° C. are then added, and agitation continues at that temperature for a further hour. 1% of 85% formic acid is then added. After a further agitation time of 30 minutes the leathers are removed from the tanning vessel, aged overnight and finished by the further process steps customary in leathermaking, such as shaving, fatliquoring, retanning, dyeing and the like.

The leathers thus obtained have a fine homogeneous and tight grain, are highly bulked, possess a smooth pleasant hand, very good color levelness and light fastness and a high tensile strength which, even after 12 weeks of storage, has the unchanged high level of the original value measured immediately after completing the leather, as the Table shows. The leathers have good self-extinguishing properties after contact with an igniting flame.

TABLE 1

Tensile strength behavior of leathers treated in Example 6, as a function of time

| Time (Weeks) | Tensile strength (kg/cm$^2$) | Elongation at break (%) |
|---|---|---|
| 0 | 134 | 40 |
| 2 | 131 | 40 |
| 6 | 129 | 35 |
| 10 | 130 | 40 |
| 12 | 135 | 36 |

EXAMPLE 7

Example 6 was repeated, except that the leathers were resins A and B.

The leathers thus obtained have a very fine, uniform and tight grain, are not very highly bulked, and have a very smooth pleasant hand.

The other properties correspond to those described in Example 6.

EXAMPLE 8

Example No. 6 was repeated, except that the leathers were treated with 10% by weight of the 1:1 mixture of resins A and B.

The leathers thus obtained are very highly bulked and firm. They have a uniform, markedly textured grain and a full pleasant hand and possess very good light fastness and color levelness. The tensile strength is not quite up to the level of that of the leathers treated in Examples 4 and 5. The leathers have excellent self-extinguishing properties after contact with an igniting flame.

EXAMPLE 9

Cattle hide is soaked, limed, fleshed, delimed and bated, all the steps being carried out as customary in the practice of leathermaking. The pH of the pelt after bating is 8.2.

The percentages of the further process steps relate to the fleshed weight of the cattle hide.

The bated pelt is introduced into a customary tanning vessel in 50% water at 38° C., 10% of the 50% cocondensate prepared in Example 3 is added, and agitation is continued for 6 hours.

A further 50% of water at 55° C. are then added, and agitation is continued at that temperature for a further hour. 1% of 85% formic acid is then added. After a further agitation time of 30 minutes the leathers are removed from the tanning vessel, aged overnight and finished by the further process steps customary in leathermaking, such as shaving, fatliquoring, retanning, dyeing and the like.

The leathers thus obtained have a uniformly fine and tight grain. They are highly bulked, soft to firm and have a round full hand. They have high tensile strength values and possess very good color levelness and light fastness.

The leathers have excellent self-extinguishing properties after contact with an igniting flame.

We claim:

1. A process for tanning leather, which comprises tanning the pelts with a resin mixture of a melamine-formaldehyde resin and an anionically modified melamine-formaldehyde resin, which anionically modified melamine-formaldehdye resin, being prepared in the presence of at least 0.3 mole of an alkali metal sulfite, alkali metal hydrogensulfite or alkali metal sulfamate, or with a partially anionically modified melamine-formaldehyde resin, which partially anionically modified melamine-formaldehyde resin being prepared in the presence of 0.15 to 0.8 mole of an alkali metal sulfite, alkali metal hydrogen sulfite or alkali metal sulfamate.

2. The process as claimed in claim 1, wherein the melamine-formaldehyde resins used have been prepared in the presence of 0 to 20% by weight of an alcohol or non-reducing sugar.

3. The process as claimed in claim 1, wherein, in the preparation of the melamine-formaldehyde resins used, up to 50% by weight of the melamine was replaced by other amino resin formers.

4. The process as claimed in claim, 1 wherein said mixture of melamine-formaldehyde resin and anionically modified melamine-formaldehyde resin consists of 20 to 80% by weight of melamine-formaldehyde resin and 80 to 20% by weight of an anionically modified melamine-formaldehyde resin.

5. In a process as claimed in claim 1, said melamine-formaldehyde resins having a molar ratio of melamine-formaldehyde of 1:1.5 to 1.6.

* * * * *